US005213616A

United States Patent [19]

Walton

[11] Patent Number: 5,213,616

[45] Date of Patent: May 25, 1993

[54] PROPULSION PROCESS FOR LIGHTWEIGHT MINIATURE TOY BOATS

[76] Inventor: George Walton, 1312 S. Silver Ave., Deming, N. Mex. 88030

[21] Appl. No.: 593,815

[22] Filed: Oct. 5, 1990

[51] Int. Cl.[5] ..... C07K 3/18; A63H 23/04

[52] U.S. Cl. ..... 106/36; 446/159; 446/163

[58] Field of Search ..... 106/36, 270, 287.23, 106/287.24, 287.3; 446/159, 163

[56] References Cited

U.S. PATENT DOCUMENTS

| | | | |
|---|---|---|---|
| 2,439,649 | 4/1948 | Cohn | 446/163 |
| 2,538,347 | 1/1951 | Yates et al. | 446/163 |
| 2,607,160 | 8/1952 | Forrest | 446/163 |
| 2,668,390 | 2/1954 | Fredericks | 446/163 |
| 2,756,539 | 7/1956 | Hirsch et al. | 446/163 |
| 2,785,505 | 3/1957 | Tomak et al. | 446/163 |
| 2,817,186 | 12/1957 | Hirsch et al. | 446/163 |
| 2,857,708 | 10/1958 | Hirsch et al. | 446/163 |
| 3,364,617 | 1/1968 | Grafe | 446/163 |

FOREIGN PATENT DOCUMENTS

| | | | |
|---|---|---|---|
| 19761 | 6/1890 | United Kingdom | 446/163 |
| 585015 | 1/1947 | United Kingdom | 446/163 |

OTHER PUBLICATIONS

"Camphor Propels Toy Sailboat", Popular Mechanics, vol. III, No. 6, Jun. 1959, p. 169.

"CRC Handbook of Chemistry & Physics", 63rd Ed., 1982-1983, CRC Press Inc., pp. F-34 and F-35.

*Primary Examiner*—Mark L. Bell

*Assistant Examiner*—Helene Klemanski

[57] ABSTRACT

The invention is a propulsion process for lightweight miniature toy boats which comprises the interaction of certain organic compounds containing certain chemical radicals with water in such manner as to temporarily increase the surface tension of water in the vicinity of application to said boats resulting in a propulsion force to propel said boats with sufficient speed and sustained activity as to constitute a novel and interesting toy for young children.

14 Claims, No Drawings

PROPULSION PROCESS FOR LIGHTWEIGHT MINIATURE TOY BOATS

BACKGROUND OF THE INVENTION a) The invention relates to a propulsion process for lightweight miniature toy boats with sufficient speed and activity duration as to constitute a novel and interesting toy.

b) Soap and camphor have been known to provide a propelling means for lightweight miniature boats. However, the effect with soap is of extremely short duration (perhaps about three to twenty seconds) and quite slow, and is thus only a subject of fleeting curiosity. Camphor is faster, and shows a much longer activity duration. However, it is a friable solid, and would be difficult for a small child to apply properly to an exact location. More importantly, camphor is highly toxic: (Fatal Dose approximately one gram for a small child: HANDBOOK OF POISONING, Lange Medical Publications, 1963). (Exposure Limit: 2 parts per million in air: NIOSH POCKET GUIDE TO CHEMICAL HAZARDS, 1985). Thus camphor would pose a definite health risk in a toy for young children.

The propelling means of my invention can give initial measured speeds of over thirty (30) feet per minute, and sustained activity for up to twenty minutes or more (at declining speeds), using substances of lower toxicity.

SUMMARY OF THE INVENTION

The invention utilizes the difference in the surface tension of water in front of and to the rear of a toy boat to provide a driving force which acts to propel said boats at such speeds and sustained motion activity so as to provide interest and play value for young children. The invention also discloses at least some of the basic scientific principles which lead to and underlie my propulsion process.

DETAILED DESCRIPTION OF THE INVENTION

As an interesting phenomenon, it has been known for a long time that a small piece of soap or camphor positioned at the rear end of a lightweight miniature toy boat could act to propel said boat forwards through the water. But as mentioned, neither substance is suitable as a propelling means for said boats in a toy intended for young children. I became curious to study this strange activity, and believe that I have discovered some of the basic scientific principles underlying the propulsion process. Application of these principles has in turn led me to discover other substances and/or mixtures which can act to propel said boats in a more lively fashion and for extended periods of such activity.

The propulsion process which I have discovered to be applicable to said boats can provide actual measured initial speeds of over 360 inches per minute, and confer continuous movement to said boats for as long as twenty minutes or even more (although the speed will decline with time). The amount of the propelling means required by my propulsion process to accomplish this is only about one drop or its equivalent. Since a large variety of chemical compounds are involved, their toxicity also varies widely; however it is possible to choose compounds and/or mixtures which have reasonably safe toxicity characteristics. These factors, when coupled with a shallow-draft water canal of interesting design, can provide a toy having excellent appeal and play value for young children.

While ALL chemicals (even table salt) pose some health risk, I have chosen (out of the large number of chemical substances which could act as potential propelling means) as the preferred embodiment of my invention chemical compounds or mixtures which present relatively minor health risks according to the currently available information in this field.

I believe that some of the principles underlying my invention are basically as follows; however, the phenomenon is apparently NOT simple, and I would not wish to be limited by my present, and possibly incomplete, understanding of the subject.

When a substance which can act as a propulsion process according to my invention is applied to the rear end of a lightweight miniature toy boat in such a manner as to permit contact with the water surface, or to at least permit vapors from said propelling substance (if the substance is volatile or capable of being sublimed) to come into contact with the water surface, then the surface tension of the water surface layer adjacent to the rear of said boat is raised to a value higher than the normal surface tension of water at that temperature. Since the surface tension of the surface layer of water in front of said boat is still at its normal lower value, a force differential exists between the front and rear of said boat which acts to literally push said boat forwards through the water.

Substances which lower the surface tension of water (or other liquid) tend to remain in the surface layer, since the free energy of the system is thereby decreased. For example, soap decreases the surface tension of water, and soap molecules thus tend to remain in the surface layer of the water. As soon as this surface layer acquires enough soap molecules to achieve a uniformly low value of surface tension (which seems to take only a few seconds) then any energy gradient or driving force would cease to exist. For this reason, according to my understanding, soap would be poorly suitable as a propelling means.

However, substances which raise the surface tension of a liquid (water in this case) increase the total free energy of the system. In order for the system to revert back to its normal lower state of free energy, it tends to eject such substances from the surface layer of said liquid. There are at least two ways (perhaps more) by which this can be accomplished: 1) if the substance is at least slightly soluble in the liquid, then the substance may be removed from the surface layer by migrating and solubilizing itself into the bulk liquid below the surface layer, 2) if the substance is sufficiently volatile, or capable of sublimation, it may remove itself by direct volatilization or sublimation into the atmosphere.

At this point, if the propelling substance is re-applied, or originally applied in such a manner as to continually renew itself or be renewed, then the process of forward propulsion will likewise be one of continued action, until the propelling substance is used up physically or its activity is stopped due to some other factor (such as the formation of a surface film).

Some of the propelling substances which I have studied appear to be self-renewing or self-sustaining, possibly because of a balanced relationship involving their rates of solubilization, volatilization, and/or migration in water. But other substances I have studied as potential propelling substances are either too volatile, too soluble, or exhibit some other characteristic nature which renders the propelling process too slow or too short-lived to provide play interest. However such substances will also come under the scope of my invention. While the chemical compounds mentioned in our preferred embodiments of the invention mention the use of certain substances for this purpose, any and all other agent/s which would accomplish our propulsion process could be considered within the scope of my invention.

There are several advantages to my propulsion process over the prior art. The boats utilizing my process are small, lightweight and very simple in construction and thus could be cheaply manufactured, compared to the relatively complex construction of boats required by the prior art. In addition, my propulsion process is extremely economical, each application requiring only one drop or its equivalent (0.05 milliliters).

My process can operate in very shallow water, even as little as ¼ inch of depth, and in smaller vessels than would be needed by the prior art, both of which factors are important in a toy dealing with water.

Because my propulsion process requires that the substances used can effectively depart from the surface layer of the water, they do not saturate this layer as rapidly, and thus do not require frequent changes of the water.

Several boats can be operated simultaneously, even in relatively small containers. My propulsion process, and the basic discovery upon which it is based, permit me to choose compounds or mixtures of relatively low toxicity as compared to the substances used by and cited in the prior art. Finally, the compounds involved in my propulsion process are susceptible to simple modes of application, compared with the cumbersome techniques such as tank-filling, wick adjustment, etc. required by the prior art.

An object of my invention is to provide a propulsion process for lightweight miniature toy boats which can propel said boats at speeds which give practical play value and appeal for young children. A further object of my invention is to provide a propulsion process for said boats which can give sustained propelling activity for time periods up to fifteen or twenty minutes or even longer. A final object of my invention is to provide a propelling means for said boats which exhibits low health hazard, and thus would be suitable in a toy for young children. Any physical or chemical systems or combination thereof, which work according to the propulsion process of my invention should properly be anticipated as a part of this invention.

I have discovered that certain classes of chemical compounds, containing certain chemical radicals or molecular configurations, can function as propelling means for lightweight miniature boats. In general, these substances contain molecular configurations which can interact with water in such a manner as to increase the surface tension of the surface layer of water when applied at the rear of said boat and so cause the boat to exhibit forward motion across the water. The compounds involved may be either organic or inorganic; however, the organic compounds are preferred.

Chemical compounds which can act as a propulsion process for said boats may contain straight-chain, branched-chain or ring-structure molecular configurations. The chemical classes which exhibit such behavior include the alcohols, organic acids, ethers, esters, aldehydes, ketones, amines, amides, imides, organic nitrites, organic nitro compounds, and nitrosoamines. While in general I feel that the longer-chain molecules may exhibit better propelling activity, practical limits are dictated to some extent by factors such as water-insolubility, volatility, rate of diffusion in water, potential surface-film formation, etc. Out of the large variety of substances which do exhibit propelling activity, many of them must be ruled out of practical consideration as potential health hazards, where young children are concerned.

The molecular groups or radicals which appear to produce the propulsion process and which appear in the chemical classes noted above include the hydroxyl, carboxyl, acyl, carbonyl, amino, amide, imide, organic nitro and organic nitrite radicals.

There are literally hundreds of thousands of chemical compounds, most of them organic in nature. Since I have discovered that there are many different chemical classes and many different chemical radicals which can act as a propelling means for lightweight miniature boats, it follows that there are many chemical compounds and/or mixtures of compounds which rightfully come under the scope of my invention. I have experimentally verified this for many such compounds and/or mixtures, and have in fact made and tested over two hundred formulations. As would be expected, the propelling speed and duration of activity shows wide variation.

Chemists skilled in the art will also realize that there are many natural substances which contain some of the chemical classes and/or radicals which I have discovered to be a propulsion process for small toy boats. For example, many natural oils contain the aldehyde radical. Most perfume oils contain aldehydes and esters. Isoamyl Acetate occurs in pear oil. Normal Octyl Alcohol is found in most citrus fruits and other natural sources. Isobutyric Acid occurs free in locust bean and in carob bean, and Ethyl Butyrate is present in pineapples. If the natural material includes reasonable percentages of one or more of the chemical classes and/or radicals which I have discovered as a propulsion process for miniature boats, then it may, or may not, be suitable for this purpose, depending upon what other components might be present. In general, the chemical mixtures present in natural materials do not perform as well as pure compound means.

The requirements that the substances of my propulsion process should exhibit at least a slight solubility in water, and should not form a surface film on water when applied thereto in small quantity, serve to restrict the organic compounds of the chemical classes mentioned to those having up to about ten carbon atoms per molecule, however, this number may vary with the actual type of compound involved.

The following chemical compounds can act to accomplish the propulsion process of my invention, although their speed and duration of activity will vary. They have been chosen to illustrate most of the chemical classes and radicals mentioned and claimed in this invention.

An overall 'Health Rating Factor' which is in current use in the chemical industry is given for each compound. The lowest rating #1 is the safest; the highest rating #3 is the least safe. The information provided is from "Hazardous Chemicals Desk Reference" by N. I. Sax and R. J. Lewis, Van Nostrand Reinhold, 1987

| Chemical Class | Compound | Health Rating |
|---|---|---|
| Acids | Lactic acid | 2 |
| Alcohols | 1-Octanol | 2 |
| Amines | Isopropylamine | 2 |
| Amides | Formamide | 3 |
| Aldehydes | Benzaldehyde | 3 |
| Esters | Isobutyl Acetate | 1 |
| Ketones | n-amyl ethyl ketone | 2 |
| Ethers | Eugenol | 2 |
| Nitrites | n-amyl nitrite | 2 |
| Nitro compounds | Nitrobenzene | 3 |

DESCRIPTION OF THE PREFERRED EMBODIMENT

Taking into account a variety of factors, the following substances which can act according to the propulsion process of my invention are currently considered to be the best embodiment thereof:

1. Isoamyl acetate, Mixed Isomers
2. N-octanol
3. Isobutyl acetate
4. Butyl lactate
5. Ethyl hexane diol These substances exemplify but do not limit my invention.

While several detailed embodiments of my invention have been described above, the extremely broad scope of my discovery obviously renders it difficult or impossible to fully encompass in detail all of the possible ways in which my invention may be accomplished, and thus this invention contemplates any mixture or combination of the mentioned chemical classes and/or radicals which may be utilized to bring about an equivalent result.

I claim:

1. A propulsion process for lightweight miniature toy boats which comprises the application thereto of chemical compounds selected from the group consisting of organic acids, organic aldehydes, organic ketones, organic alcohols, organic esters, organic ethers, organic amines, organic amides, organic amides, organic nitrites and organic nitro compounds exclusive of soap or camphor which can in the vicinity of their application to said boats in quantities equal to or less than 0.05 milliliter interact with water to temporarily increase the surface tension of the top layer of water thus providing a propulsive force to said boats but which can also act in a manner to effectively remove said compounds from said surface layer of water.

2. A propulsion process as recited in claim 1 which comprises organic acids which exhibit the proper volatility, water-solubility and/or water-diffusibility to confer propelling activity but which do not form a persistent surface film when applied to said boats in amounts less than 0.05 milliliter.

3. A propulsion process as recited in claim 1 which comprises organic aldehydes which exhibit the proper volatility, water-solubility and/or water-diffusibility to confer propelling activity but which do not form a persistent surface film when applied to said boats in amounts less than 0.05 milliliter.

4. A propulsion process as recited in claim 1 which comprises organic ketones which exhibit the proper volatility, water-solubility and/or water-diffusibility to confer propelling activity but which do not form a persistent surface film when applied to said boats in amounts less than 0.05 milliliter.

5. A propulsion process as recited in claim 1 which comprises organic alcohols having four or more carbon atoms which exhibit the proper volatility, water-solubility and/or water-diffusibility to confer propelling activity but which do not form a persistent surface film when applied to said boats in amounts less than 0.05 milliliter.

6. A propulsion process as recited in claim 1 which comprises organic esters which exhibit the proper volatility, water-solubility and/or water-diffusibility to confer propelling activity but which do not form a persistent surface film when applied to said boats in amounts less than 0.05 milliliter.

7. A propulsion process as recited in claim 1 which comprises organic ethers which exhibit the proper volatility, water-solubility and/or water-diffusibility to confer propelling activity but which do not form a persistent surface film when applied to said boats in amounts less than 0.05 milliliter.

8. A propulsion process as recited in claim 1 which comprises organic amines which exhibit the proper volatility, water-solubility and/or water-diffusibility to confer propelling activity but which do not form a persistent surface film when applied to said boats in amounts less than 0.05 milliliter.

9. A propulsion process as recited in claim 1 which comprises organic amides which exhibit the proper volatility, water-solubility and/or water-diffusibility to confer propelling activity but which do not form a persistent surface film when applied to said boats in amounts less than 0.05 milliliter.

10. A propulsion process as recited in claim 1 which comprises organic imides which exhibit the proper volatility, water-solubility and/or water-diffusibility to confer propelling activity but which do not form a persistent surface film when applied to said boats in amounts less than 0.05 milliliter.

11. A propulsion process as recited in claim 1 which comprises organic nitrites which exhibit the proper volatility, water-solubility and/or water-diffusibility to confer propelling activity but which do not form a persistent surface film when applied to said boats in amounts less than 0.05 milliliter.

12. A propulsion process as recited in claim 1 which comprises organic nitro compounds which exhibit the proper volatility, water-solubility and/or water-diffusibility to confer propelling activity but which do not form a persistent surface film when applied to said boats in amounts of less than 0.05 milliliter.

13. A propulsion process as recited in claim 1 which comprises admixtures of said chemical compounds.

14. A propulsion process as recited in claim 1 further comprising essential oils.

* * * * *

UNITED STATES PATENT AND TRADEMARK OFFICE

CERTIFICATE OF CORRECTION

PATENT NO. : 5,213,616
DATED : May 25, 1993
INVENTOR(S) : George Walton

It is certified that error appears in the above-indentified patent and that said Letters Patent is hereby corrected as shown below:

Column 5, line 43, claim 1, "amines, organic amides, organic amides, organic nitrites" should read -- amines, organic amides, organic imides, organic nitrites--.

Signed and Sealed this

Seventh Day of December, 1993

*Attest:*

*Attesting Officer*

BRUCE LEHMAN

*Commissioner of Patents and Trademarks*